US009186717B2

(12) United States Patent
Elsmore et al.

(10) Patent No.: US 9,186,717 B2
(45) Date of Patent: Nov. 17, 2015

(54) PUNCH ASSEMBLY WITH SEPARATE ADJUSTABLE PUNCH GUIDING SHIM BLOCK

(71) Applicant: Mate Precision Tooling, Inc., Anoka, MN (US)

(72) Inventors: Mitchell I. Elsmore, Cottage Grove, MN (US); Dennis K. Lowry, Princeton, MN (US); Ronald C. Windingstad, White Bear Township, MN (US)

(73) Assignee: Mate Precision Tooling, Inc., Anoka, MN (US)

( * ) Notice: Subject to any disclaimer, the term of this patent is extended or adjusted under 35 U.S.C. 154(b) by 448 days.

(21) Appl. No.: 13/655,771

(22) Filed: Oct. 19, 2012

(65) Prior Publication Data

US 2014/0109742 A1 Apr. 24, 2014

(51) Int. Cl.

*B21D 45/08* (2006.01)
*B21D 45/00* (2006.01)
*B21D 28/34* (2006.01)

(52) U.S. Cl.

CPC ..... *B21D 45/006* (2013.01); *B21D 28/346* (2013.01); *Y10T 83/2155* (2015.04)

(58) Field of Classification Search

CPC ..... B21D 37/04; B21D 28/00; B21D 28/02; B21D 28/04; B21D 28/12; B21D 28/26; B21D 45/00; B21D 45/02; B21D 45/08; B21D 45/06; B26D 7/26; B26F 1/00; B26F 1/02; B26F 1/04; B26F 1/14; B26F 1/38; B26F 1/40; Y10T 83/2155; Y10T 83/2096; Y10T 83/2122; Y10T 83/2124; Y10T 83/2127; Y10T 83/2133; Y10T 83/2135; Y10T 83/2146; Y10T 83/2159; Y10T 83/2163; Y10T 83/2166; Y10T 83/99423; Y10T 83/9428; Y10T 83/9437; Y10T 83/9447

USPC ..... 83/138, 111, 123–125, 128, 129, 134, 83/140, 142, 143, 684, 686, 690, 694, 83/698.91, 699.11

See application file for complete search history.

(56) References Cited

U.S. PATENT DOCUMENTS

| | | | | |
|---|---|---|---|---|
| 1,723,935 | A * | 8/1929 | Henricson | 83/140 |
| 4,375,774 | A * | 3/1983 | Wilson et al. | 83/140 |
| 5,329,835 | A * | 7/1994 | Timp et al. | 83/686 |
| 5,992,285 | A * | 11/1999 | Talarico | 83/684 |
| 6,074,330 | A * | 6/2000 | Ostini | 483/29 |
| 6,276,247 | B1 * | 8/2001 | Helda | 83/684 |
| 7,954,404 | B2 | 6/2011 | Thielges | |
| 7,975,523 | B2 | 7/2011 | Schneider | |
| 2004/0079134 | A1 * | 4/2004 | Lowry et al. | 72/480 |
| 2009/0266208 | A1 * | 10/2009 | Zhou et al. | 83/128 |
| 2010/0162866 | A1 * | 7/2010 | Nakai | 83/140 |

FOREIGN PATENT DOCUMENTS

| | | | |
|---|---|---|---|
| DE | 10255219 | B3 | 3/2004 |
| EP | 1213065 | B1 | 12/2002 |
| EP | 1406752 | B1 | 4/2004 |
| EP | 1667826 | B1 | 6/2006 |

* cited by examiner

*Primary Examiner* — Phong Nguyen

(74) *Attorney, Agent, or Firm* — James V. Harmon; Nikolai & Mersereau, P.A.

(57) ABSTRACT

A punch assembly for a hydraulic punch press machine that affords the ability to compensate for punch point metal loss due to resharpening by facilitating accurate repositioning of the punch point relative to an aperture in a stripper plate through which the punch point member projects during a stamping stroke of the punch assembly.

24 Claims, 4 Drawing Sheets

PUNCH ASSEMBLY WITH SEPARATE ADJUSTABLE PUNCH GUIDING SHIM BLOCK

BACKGROUND OF THE INVENTION

I. Field of the Invention

This invention relates generally to high-speed automated punch press for processing sheet metal and more particularly to the design of a punch assembly used in such machines.

II. Description of the Prior Art

In producing various products from sheet metal, it is often necessary to punch out predetermined hole patterns in the sheet metal workpiece. This is commonly done by a machine that positions a punch assembly and then employs a hydraulic ram to drive a sharpened punch point member of a predetermined shape through the workpiece and into a die underlaying the workpieces, thereby creating an aperture through the sheet metal of the predetermined shape.

After repeated strokes of the punch, the punch point can become dull and requires sharpening so that it is able to produce well-defined apertures. Repeated sharpening cycles remove metal from the punch point so that it can no longer punch through the workpiece and only serves to distort the workpiece, resulting in an undesired scrap rate. In most punch assemblies, when repeated sharpenings have been performed, it becomes necessary to replace the punch assembly's punch point with a new one, which is a relatively costly solution. Thus, a need exists for a way to increase the useful life of a punch assembly's punch point. The present invention satisfies this need.

Prior art metal punch assemblies have relied on the use of urethane strippers to allow punching close to non-flat workpiece surfaces. Such urethane strippers, however, suffer from the fact that they are incapable of accurately holding the workpiece during punching, resulting in misalignment of the punched hole. Also, urethane strippers are subject to rapid wear.

SUMMARY OF THE INVENTION

The present invention comprises a punch assembly for a punch press machine where the punch assembly has a shank centrally located on an integrally formed circular alignment ring that serves to orient the punch assembly within the punch press in alignment with its ram. Coupled to the alignment ring by shoulder bolts is a stripper plate, the shoulder bolts permitting limited reciprocal displacement of the alignment ring toward and away from the stripper plate. Disposed between the alignment ring and the stripper plate are a plurality of compression springs that normally urge the stripper plate away from the alignment ring. Fastened to the undersurface of the alignment ring and movable therewith is a generally rectangular shim block that has a slot formed in its undersurface in which a punch point member is fastened. More particularly, the punch point member has an upper portion fastened within the slot of the shim block and a lower sharpened portion displaceable through a correspondingly-shaped aperture formed through a thickness dimension of the stripper plate. As the punch point member becomes shorter due to repeated sharpening, in accordance with a first embodiment, shim stock can be inserted between the undersurface of the adjustment ring and an upper surface of the shim block, thus placing the sharpened portion of the punch point member even with the bottom edge of the aperture formed through the thickness dimension of the stripper plate. In a second embodiment, a threaded connection between the shank and the alignment ring allows adjustment of the punch point member to accommodate for metal loss due to resharpening.

The use of a steel stripper plate along with mechanical springs offers distinct advantages over the use of urethane strippers as in the prior art. First, mechanical springs far outlast urethane and the use of a metal stripper plate is found to be superior in the ability to hold the workpiece in place during punching for more accurate hole placement. By proper design, as in the present invention, the stripper plate further serves as a guide for the punch point, a feature not achievable with urethane strippers.

The foregoing features and advantages of the invention will become apparent to persons skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
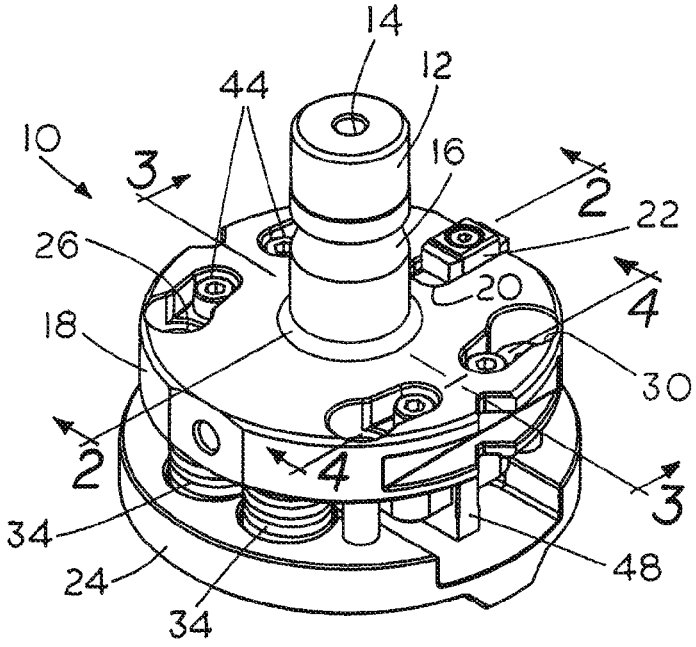
FIG. 1 is a perspective view of a first embodiment of the punch assembly of the present invention.

This description of the preferred embodiments is intended to be read in connection with the accompanying drawings, which are to be considered part of the entire written description of this invention. In the description, relative teens such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

Shown in FIG. 1 and identified generally by numeral 10 is a preferred embodiment of a punch assembly for a punch press machine, such as the TruPunch 1000 available from Trumph Inc. of Farmington, Conn. It is seen to comprise a generally cylindrical shank 12 having a central bore 14, the shank also having a tapered notch 16 for mating with a hydraulic ram forming a part of the overall punch press. The shank 12 is centrally disposed and projects upwardly from an alignment ring 18 that is used to orient the punch assembly with respect to the punch press in which the punch assembly is designed to be used. Disposed in a U-shaped slot 20 formed inward from the upper surface of the alignment ring 18 is a key 22 that is held in place by a cap screw and that is also designed to fit into a key way formed in the hydraulic ram (not shown) used to drive the punch assembly 10.

Figure 4:
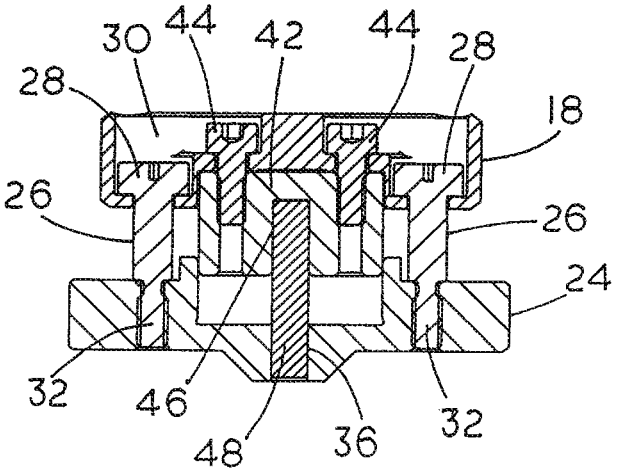
FIG. 4 is a cross-section view taken along line 4-4 in FIG. 1.

A stripper plate 24 is coupled to the alignment ring 18 by a plurality of shoulder bolts, best seen in the cross-sectional view of FIG. 4 and identified by numeral 26. The heads 28 of the shoulder bolts 26 are recessed in counterbores, as at 30, formed inward of the upper surface of the alignment ring 18. The threaded portions 32 of the shoulder bolts 26 mate with internal threads in bores drilled through the thickness dimension of the stripper plate 24, all as best seen in the cross-sectional view of FIG. 4. The use of shoulder bolts for coupling the stripper plate 24 to the alignment ring 18 allows a reciprocal displacement of the alignment ring toward and away from the stripper plate. Alternatively, a bushing to set the height and a standard screw may be employed.

Figure 2:
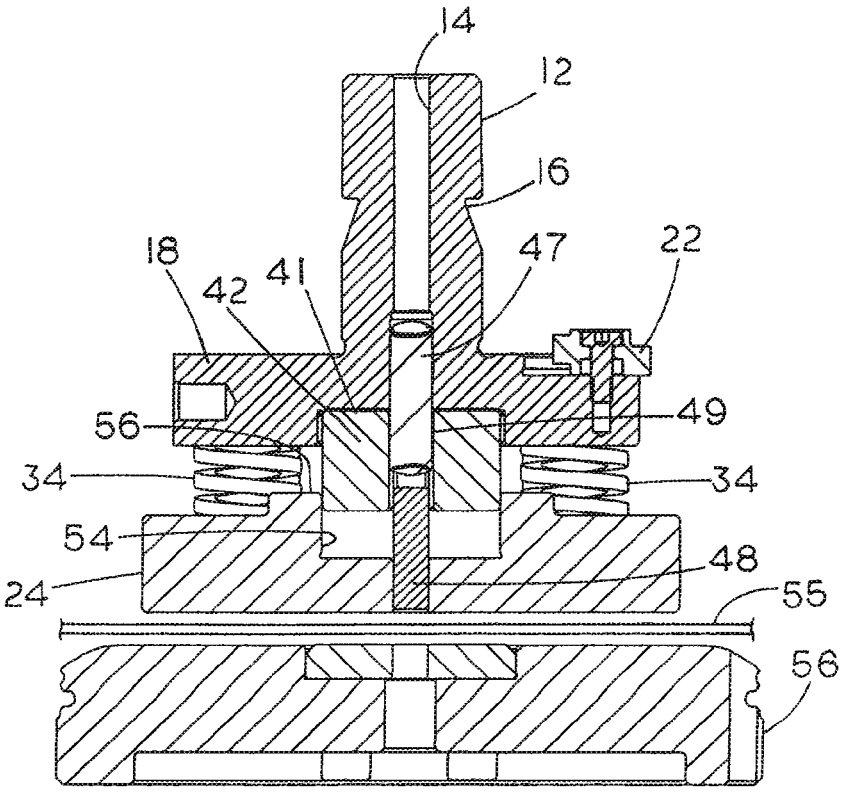
FIG. 2 is a cross-section view taken along line 2-2 in FIG. 1.

A plurality of compression springs, as at 34, in FIGS. 1 and 2 are disposed between the alignment ring 18 and the stripper plate 24 for normally urging the stripper plate away from the alignment ring. Both the alignment ring and the stripper plate include cylindrical pockets, as at 35, formed in facing surfaces thereof for capturing the opposed end portions of the compression springs 34.

Figure 5:
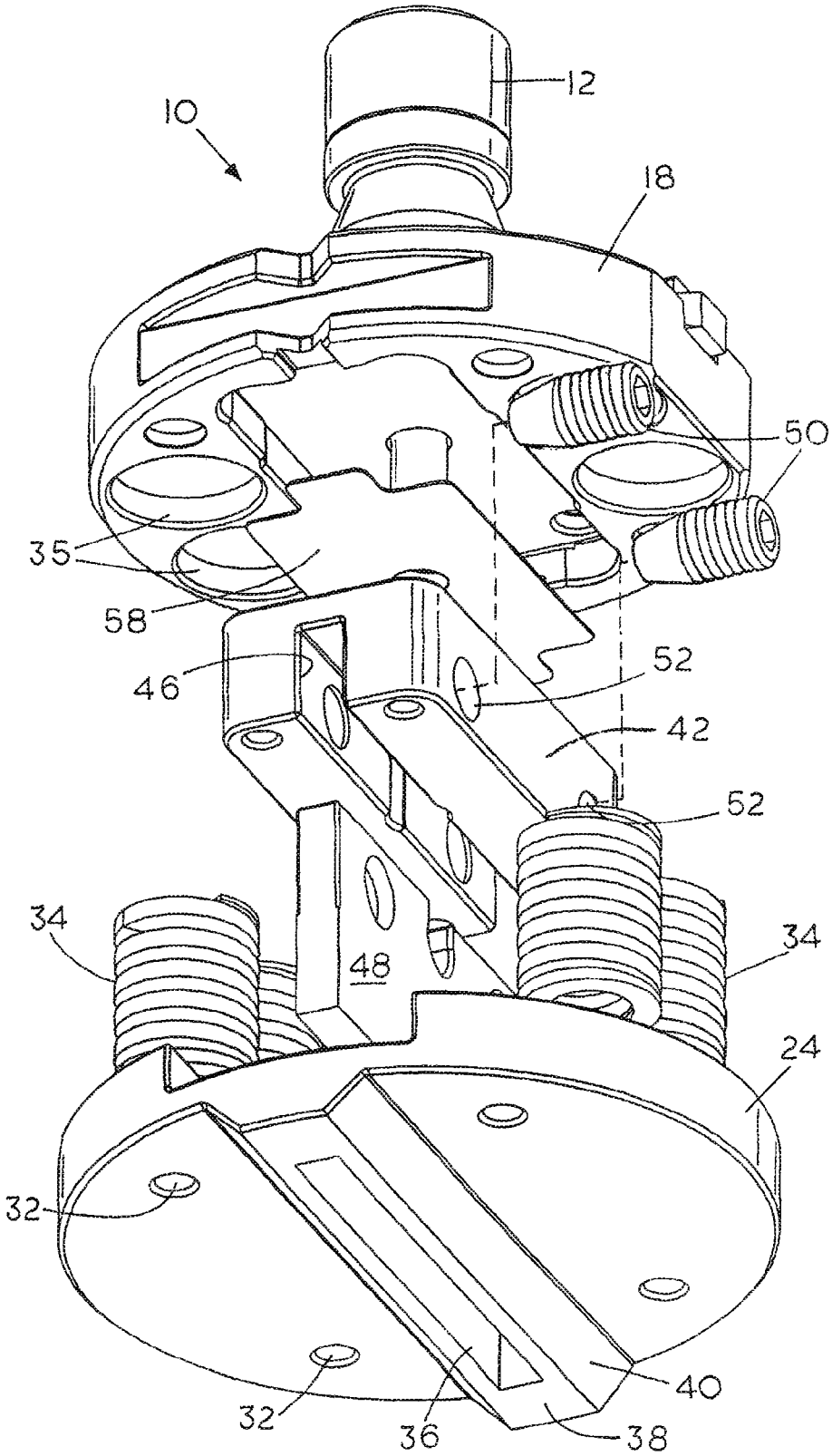
FIG. 5 is an enlarged, exploded perspective view of the punch assembly of FIG. 1.

As best seen in the view of FIG. 5, an aperture in the form of a rectangular slit 36 is formed through the thickness dimension of the stripper plate and which is centered within a downwardly projecting ridge 38 having beveled sides as at 40. By having this ridge, a workpiece to be punched need not be totally flat because only the bottom of the ridge surrounding the aperture contacts the workpiece.

In FIG. 2, it can be seen that a generally rectangular recess 41 is formed inward in the bottom surface of the alignment ring 18, that recess being aligned with and centered relative to a central axis of the shank 14 and fitted into this recess is a shim block 42 that is held in place at cap head screws, as at 44 (FIG. 4). The shim block has a centrally disposed slot 46 as best seen in FIG. 5 formed in its undersurface. As seen in FIG. 2, an alignment pin 47 fitted down the bore 14 drilled upward along a center line of the shank 12 also fits through a bore 49 in the shim block 42 to ensure accurate registration.

A punch point member 48 has an upper portion thereof fitted into the slot 46 of the shim block 42 and is fastened to the shim block by retaining setscrews 50 screwed into threaded bores 52 that extend transversely through the sidewalls of the shim block 42 to intersect with and retain the punch point member 48. The alignment pin 47 also extends into a notch 51 (FIG. 3) centered in the upper portion of the punch point member 48 to locate it with respect to the shim block 42 and the shank 12.

Formed in the upper surface of the stripper plate 24 in registration with a lower portion of the shim block 42 is an accurately machined inset 54 having upwardly extending bosses 56 for guiding the shim block 42 and therefore the punch point member 48 during its descent stroke and subsequent rise in a punching operation.

Figure 3:
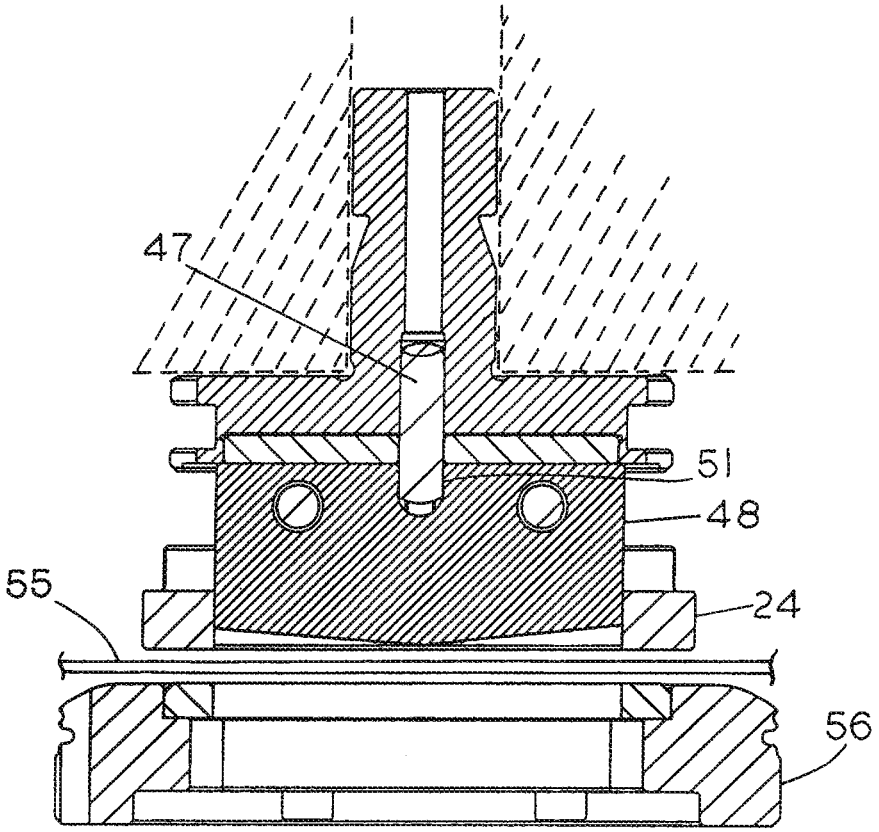
FIG. 3 is a cross-section view taken along line 3-3 in FIG. 1.

The punch point member illustrated in the drawings is designed to create a long narrow rectangular slit in a workpiece as at 55 positioned between the stripper plate 24 and a die member 56. A die member is built into the overall punch press and is separate from the punch assembly comprising the present invention. To facilitate punching such a slit in the workpiece 55, the punch point member 48 is provided with a sharpened, somewhat V-shaped working edge as best seen in FIG. 3. Those skilled in the art can appreciate that if a different shaped hole is to be punched, the punch point member would be machined to have the desired shape and the shim block 42 would be machined to accommodate receiving the particular punch point member. Further, the shim block and punch point member may be formed as a unitary piece.

In operation, the punch assembly shown in FIG. 1 would be inserted into a punch press, such as a Trumph TruPunch 1000 and appropriately oriented by fitting the key 22 into a keyway of the punch press. The machine's hydraulic ram is arranged to cooperate with the upper surface of the alignment ring 18 and the shank 12 to move the stripper plate 24 in contact with a workpiece 55 and pressing workpiece 55 onto the die 56. The force of the ram also compresses the compression springs 34 as the alignment ring 18 slides downward guided by the shoulder bolts 26. Because of the manner in which the shim block 42 and the punch point member 48 are fastened to the undersurface of the alignment ring 18, a point will be reached at which the sharpened lower edge of the punch point member will press through the workpiece 55 and force a slug through the die 56 leaving an open slit.

When the punching force of the ram is removed, the compression springs 34 will again expand to increase the separation between the stripper plate 24 and the alignment ring 18, thus stripping the workpiece 55 free from the punch point member 48.

As explained earlier, after repeated punch strokes, the working edge of the punch point member 48 tends to dull and requires sharpening. This, of course, decreases the height dimension of the punch point member and a point will be reached where the punch point member cannot be further sharpened and expected to continue to function properly. In prior art systems, this required replacement of the punch point member. In the case of the present invention, however, the life of the punch point member can be extended by simply unscrewing the four shoulder bolts holding the stripper plate to the alignment ring and removing the four bolts securing the shim block to the undersurface of the alignment ring and inserting a piece of shim stock as at 58 in FIG. 5 between the shim block 42 and the alignment ring 18, as best seen in FIG. 5. The shoulder bolts and screws would then be replaced. This has the effect of adjusting the extent that the lower portion of the punch point member extends through the aperture 36 in the bottom of the stripper plate and compensates for the amount of material removed from the punch point member in previous sharpening operations.

Figure 6:
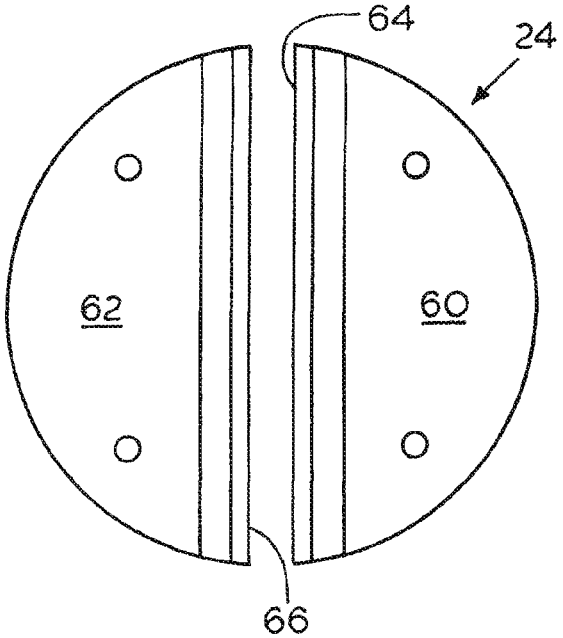
FIG. 6 is a plan view of an alternative stripper plate.

FIG. 6 is included merely to show that the stripper plate 24 can comprise separate halves 60 and 62 with a precision gap established between the facing edges 64 and 66 rather than a unitary piece as best seen in FIG. 5.

Alternative Embodiment

Figure 7:
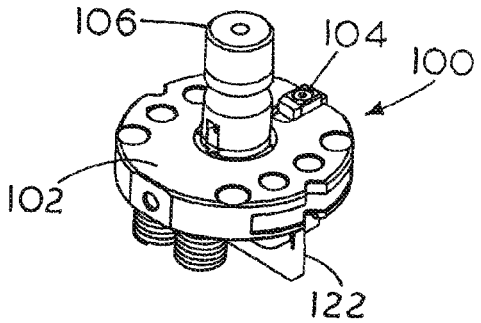
FIG. 7 is a perspective view of a second embodiment of the punch assembly of the present invention.

FIG. 7 illustrates an alternative embodiment for adjusting the effective length of a punch point member following repeated sharpening of its working edge. Here, only the shank, alignment ring and the compression springs are shown, but those skilled in the art can readily perceive from these views how the stripper plate is attached by shoulder bolts as in the embodiment of FIG. 1.

Figure 9:
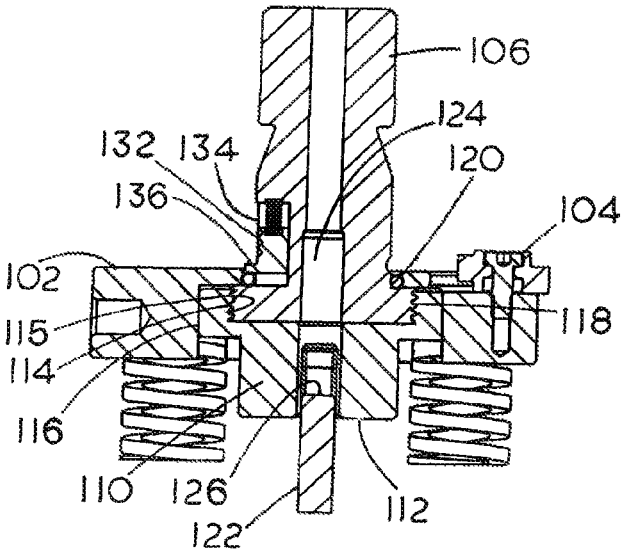
FIG. 9 is a cross-section taken along line 9-9 in FIG. 8.

The alternative embodiment is indicated generally by numeral 100 in FIG. 7 and is seen to include an alignment ring 102 with a key 104 that functions like key 22 in the embodiment of FIG. 1 to accurately align the punch assembly in a punch press. Rather than having the shank 106 integral with the alignment ring 102 as in the earlier embodiment, as seen in FIG. 9, the shank member 106 has an externally threaded base portion 108.

The punch point holder block 110 has a generally rectangular lower portion 112 of a lesser width dimension than its upper portion 114 and formed inwardly from a top surface of the upper portion 114 is a cylindrical bore 115 having internal threads. The upper portion 114 of the punch point holder block 110 is machined to have a sliding fit within a rectangular pocket 116 formed in the undersurface of the alignment ring 102.

The shank 106 has its upper portion projecting upward through a central bore in the alignment ring 102 and a cylindrical base portion 118 that is externally threaded allowing it to be screwed into the threaded bore 115 in the upper portion 114 of the punch point holder block 112. A retaining ring 120 holds the shank 106 in place relative to the alignment ring 102.

As in the earlier described embodiment, punch point member 122 is accurately aligned with the shank 106 by the inclusion of a centering pin 124 that extends through a bore in the punch pint holder block 110 and into a notch 126 formed in a top portion of the punch point member.

Figure 8:
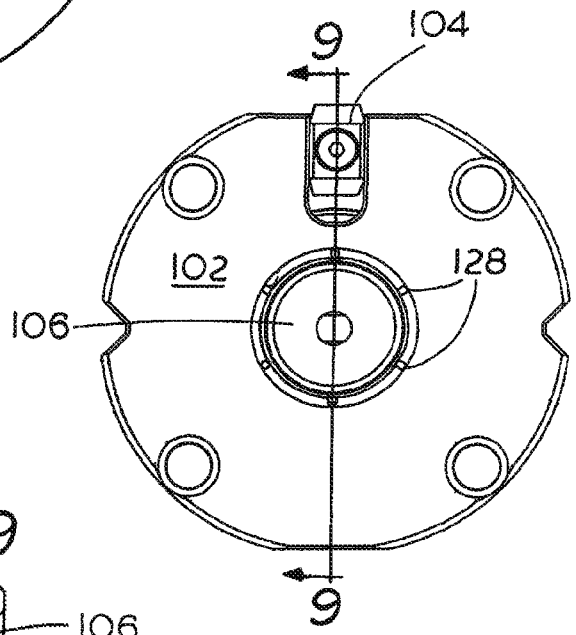
FIG. 8 is a top plan view of the embodiment of FIG. 7.

In FIG. 8, there can be seen a series of regularly spaced notches, as at 128, formed in the alignment ring and surrounding the shank 106.

FIG. 9 shows a spring-loaded slidable latch 132 disposed in a slot 134 formed vertically in the periphery of the shank. The latch 132 has a finger 136 that can be made to fit into any of the slots 128 to prevent rotation of the shank 106 relative to the alignment ring 102. However, by lifting the latch 132 against the force of the spring, the finger 136 is removed from a slot 128, allowing the shank to be rotated and screwed up or down, depending on the direction of rotation and thereby accurately adjusts the position of the working end of the punch point member 122 relative to the exit opening 36 of a stripper plate 24 (FIG. 5) without changing the length of the projecting upper portion of the shank relative to the top surface of the alignment ring. The magnitude of the displacement is then determined by the pitch of the threads on the base 108 of the shank and the degrees of rotation and between the slots 128 selected as a stop point.

After a number of sharpening operations on the punch point member 122, the downward adjustment is made by lifting the latch 132 so that its finger 136 no longer resides in a slot 128 while at the same time rotating the shank clockwise when viewed in FIG. 8. This displaces the punch point holder block 110 downward. When a desired setting is reached, the spring-loaded latch 132 is released into a selected one of the slots 130.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A punch assembly for use in a punch press comprising:

(a) a shank adapted to be engaged by a ram of a punch press, the shank positioned at a center of an alignment ring and projecting upwardly therefrom, said alignment ring having a key member for orienting the punch assembly with respect to the punch press in which the punch assembly is to be used;

(b) a stripper plate coupled to the alignment ring by a plurality of longitudinally extending fasteners allowing reciprocal displacement of the alignment ring toward and away from the stripper plate, the stripper plate having an aperture formed through a thickness dimension thereof;

(c) at least one resilient member disposed between the alignment ring and the stripper plate for normally urging the stripper plate away from the alignment ring; and (d) a shim block fastened to an undersurface of the alignment ring and movable therewith, the shim block supporting and guiding a punch point member during longitudinal displacement thereof with a lower portion of the punch point member displaceable through the aperture formed through a thickness dimension of the stripper plate.

2. The punch assembly of claim 1 wherein at least one of the alignment ring and the stripper plate includes a pocket formed in facing surfaces thereof for capturing opposed end portions of the at least one resilient member.

3. The punch assembly of claim 1 and further including a key member projecting outward from an upper surface of the alignment ring.

4. The punch assembly of claim 1 and further including a shim stock member disposed between the shim block and the undersurface of the alignment ring for adjusting the extent that the lower portion of the punch point member extends through the aperture in the stripper plate.

5. The punch assembly of claim 1 wherein the shim block and punch point member are integrally formed.

6. The punch assembly of claim 1 wherein the shim block has a recess formed in an undersurface thereof and the punch point member has an upper portion fastened within the recess of the shim block.

7. The punch assembly of claim 6 and further including an alignment pin fitted at one end in a bore aligned with a central axis of the shank and at the other end in a bore passing through the shim block into an alignment slot formed in the upper portion of the punch point member.

8. The punch assembly as in claim 1 wherein the aperture formed through the thickness dimension of the stripper plate is of a shape corresponding to that of a lower end of the punch point member.

9. The punch assembly of claim 8 wherein the lower end of the punch point member has a V-shape edge.

10. The punch assembly as in claim 1 wherein the stripper plate includes a centrally located, downwardly projecting ridge having beveled sides on an undersurface thereof and with the aperture being formed through the ridge.

11. The punch assembly as in claim 1 wherein the stripper plate includes plural guide surfaces for constraining sideways deflection of the shim block and the punch point is guided from the stripper plate by walls defining said aperture during a punching stroke to assure accurate hole location punching in a workpiece.

12. The punch assembly as in claim 1 wherein the stripper plate comprises a pair of spaced-apart arcuate segments.

13. The punch assembly of claim 1 wherein the shank is integrally joined to the alignment ring.

14. The punch assembly of claim 1 wherein the shank is coupled by screw threads to the punch point member for allowing length adjustment.

15. The punch assembly of claim 14 and further including a spring loaded latch operatively coupled between the shank and the alignment ring for establishing discrete angular settings of the shank on the alignment ring and rotation of the shank relative to the alignment ring repositions the shim block and punch point member relative to the aperture in the stripper plate.

16. A punch assembly for use in a punch press comprising:

(a) a shank adapted to be engaged by a ram of a punch press, the shank positioned at a center of an alignment ring and projecting upwardly therefrom, the alignment ring having a protuberance adapted to orient the punch assembly with respect to the punch press in which the punch assembly is to be used;

(b) first and second stripper plates coupled to the alignment ring by a plurality of fasteners allowing reciprocal displacement of the alignment ring toward and away from the stripper plates, the first and second stripper plates being spaced apart laterally to form a gap therebetween, the first and second stripper plates each including a centrally located, downwardly projecting ridge having beveled sides on an undersurface thereof and with the gap being formed through the ridge;

(c) at least one resilient member disposed between the alignment ring and the first and second stripper plates for normally urging the stripper plates away from the alignment ring; and (d) a shim block fastened to an undersurface of the alignment ring and movable therewith, the shim block supporting and guiding a punch point member with a lower portion of the punch plate displaceable through the gap between the first and second stripper plates.

17. The punch assembly of claim 16 wherein one of the alignment ring and the stripper plates includes a pocket formed in facing surfaces thereof for capturing opposed end portions of the at least one resilient member.

18. The punch assembly of claim 16 and further including a key member projecting outward from an upper surface of the alignment ring and adapted to engage a keyway in the punch press.

19. The punch assembly of claim 16 and further including a shim stock member disposed between the shim block and the undersurface of the alignment ring for adjusting the extent that the lower portion of the punch point member extends through the aperture in the stripper plate.

20. The punch assembly of claim 16 wherein the shim block and punch point member are integrally formed.

21. The punch assembly of claim 16 wherein the shim block has a recess formed in an undersurface thereof and the punch point member has an upper portion fastened within the recess of the shim block.

22. The punch assembly of claim 21 and further including an alignment pin fitted at one end in a bore aligned with a central axis of the shank and at the other end in a bore passing through the shim block into an alignment slot formed in the upper portion of the punch point member.

23. The punch assembly as in claim 16 wherein the gap formed between the first and second stripper plates is of a shape corresponding to that of a lower end of the punch point member.

24. The punch assembly as in claim 16 wherein the stripper plates include guide surfaces for constraining sideways deflection of the shim block and the punch point is guided from the stripper plates by walls defining said gap during a punching stroke to assure accurate hole location punching in a workpiece.

* * * * *